United States Patent [19]

Kernell

[11] 3,939,601

[45] Feb. 24, 1976

[54] SPINNING TOY

[76] Inventor: Samuel H. Kernell, 1052 Railton, Memphis, Tenn. 38111

[22] Filed: Oct. 26, 1972

[21] Appl. No.: 301,083

[52] U.S. Cl. ..... 46/47

[51] Int. Cl.[2] ..... A63H 1/32

[58] Field of Search ..... 46/47, 48, 1 R, 50, 60, 46/64, 67, 71; 273/106 B

[56] References Cited

UNITED STATES PATENTS

| | | | |
|---|---|---|---|
| 476,825 | 6/1892 | Schwartz | 46/47 |
| 1,404,132 | 1/1922 | Manes | 46/47 UX |
| 2,098,168 | 11/1937 | Sperry | 46/47 |
| 2,807,470 | 9/1957 | Keuls | 46/47 X |
| 3,077,051 | 2/1963 | Quinones | 46/47 X |

*Primary Examiner*—Louis G. Mancene
*Assistant Examiner*—J. Q. Lever
*Attorney, Agent, or Firm*—John R. Walker, III

[57] ABSTRACT

A toy which may be spun about on a flat surface and which is intended to be activated by a sharp pointed rod or pencil. The toy is characterized by a disklike body having a circular rim which is disposed on the bottom thereof and runningly engages the flat surface as the toy is caused to be activated. An upwardly directed concentrically disposed socket is included for guidingly receiving the sharp end of the rod. A downwardly directed intermittent force suitably applied to the rod causes the toy to wobble about indefinitely on the flat surface, i.e., subsequent to the toy's first having been manually started to wobble. Weight may be added to the toy adjacent the periphery thereof to facilitate the wobble spinning action.

7 Claims, 4 Drawing Figures

SPINNING TOY

BACKGROUND OF THE INVENTION

1. Field of the Invention:

This invention pertains to the field of spinning toys.

2. Description of the Prior Art:

A preliminary patentability search revealed the following U.S. Patents: Schwartz Pat. No. 476,825; Graves Pat. No. 1,952,547; and Quinones Pat. No. 3,077,051. None of the above patents show or suggest applicant's device. It should be pointed out that the '825 patent pertains to a spinning toy that may be revolved on the tip of a stick and includes a disk having a concentrically disposed conical socket and an outwardly flaring flange. However, the socket is downwardly directed, and the flange is adjacent the concentric socket.

The spinning toy of the '051 patent is also provided with a downwardly directed socket, i.e., when the device is used as a spinning toy as shown in FIG. 2 of the drawing. The device of the '051 patent is provided with an upwardly directed projection having a slot for receiving a nameplate. The device is further disclosed in use as a toy boat in which the hemispherical member is inverted and the nameplate becomes a rudder. In this form of the invention, an upstanding stick is positioned in the socket and has a sail attached thereto.

SUMMARY OF THE INVENTION

The present invention is directed toward providing a toy which may be spun about on a flat surface and which is intended to be activated by a sharp pointed rod or pencil. The toy is characterized by a disklike body having a circular rim which is disposed on the bottom thereof and runningly engages the flat surface as the toy is caused to be activated. An upwardly directed concentrically disposed protuberance having a conical shaped socket provided therein is included for guidingly receiving the sharp end of the rod. The toy may be forced to wobble about indefinitely on the flat surface by applying a downwardly directed intermittent force along the longitudinal axis of the rod, i.e., subsequent to the toy's first having been manually started to wobble. The wobble action of the toy can best be described by comparing it to the unstable spinning motion of a coin as it vacillates while slowing down after having been spun about on its edge, i.e., the plane of the coin being neither horizontal nor vertical. Weight preferably is added to the toy adjacent the periphery thereof to facilitate sustaining the wobble spinning action. Additionally, a downwardly directed hub preferably is included which is fixedly attached to the body for converting a substantially stable spinning movement of the toy to the wobble unstable spinning movement. In other words, the hub extends below the circular rim and spinning the toy while supported by the hub results in the toy's tilting slightly which engages the rim with the flat surface. Thus, the rim, having more linear velocity, runningly engages the flat surface, causing the toy to quickly assume the wobble spinning movement as the hub becomes totally disengaged therefrom, i. e., the major plane of the toy being neither horizontally nor vertically disposed.

DESCRIPTION OF THE PREFERRED EMBODIMENT

Figure 1:
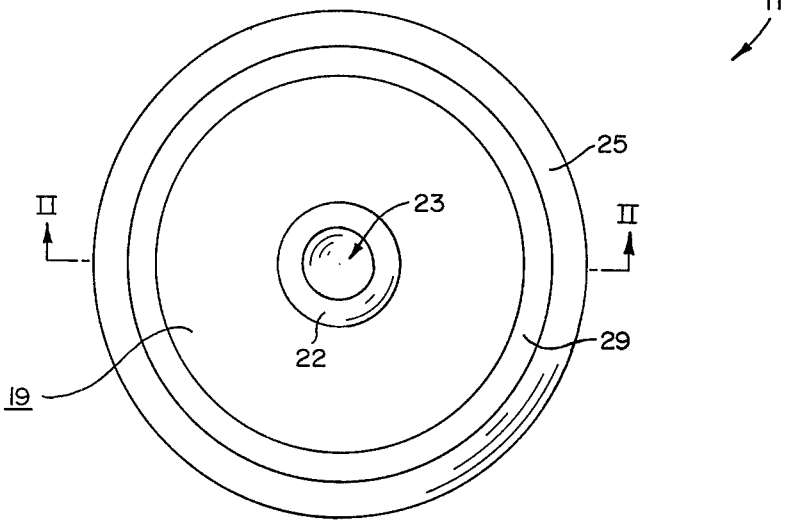
FIG. 1 is a top plan view of the toy of the present invention.

The spinning toy 11 of the present invention is intended to be spun about on a planar surface as at 13 and may be activated by an elongated rod 15 having a sharp pointed end 17. The elongated rod 15 may optionally be a sharpened pencil, and when the term "rod" is used herein, it is deemed also to include a sharpened pencil or the like. The toy includes a disklike body 19 which has a circular rim 21 for engaging the planar surface 13 as the toy is actuated. From FIG. 2 of the drawings, it may be seen that the rim 21 is disposed on the bottom of the body 19 and defines the perimeter thereof. Also included is an upwardly directed concentrically disposed protuberance 22 having a conical shaped socket 23 provided therein for guidingly receiving the sharp pointed end of the rod 15. The rod 15 is suitably used to cause an acceleration of a wobble spinning movement of the toy 11, i.e., an intermittent downwardly directed force is applied to the rod 15 along the longitudinal axis thereof. More specifically, the acceleration is attributable to the following steps: First, placing the toy 11 upon the planar surface 13 with the conical socket 23 facing upward. Second, manually spinning the toy 11 with the rim 21 engaging the planar surface in a wobble unstable manner, i.e., similar to the familiar spinning or wobble movement of a coin as above described. Third, inserting the pointed end 17 of the rod 15 into the conical socket 23. Fourth, applying an intermittent gentle downwardly directed force along the longitudinal axis of the rod 15.

Additionally, the toy includes a flangelike ring member 25 defining the perimeter of the toy 11 and establishing the rim 21. Also included is a disk member 27 which fills in the otherwise open center of the ring 25 and is fixedly attached thereto. The disk member 27 is disposed substantially intermediate the width of the flangelike ring member 25 establishing upwardly and downwardly directed flange portions 29, 31, i.e., the circular rim 21 being the lowermost portion of the downwardly directed flange portion 31. It should be understood that the upwardly directed protuberance 22 is fixedly attached to the disk member 27 centrally thereof. Additionally, the flange portion 29 is superjacent the rim 21 and extends upwardly a predetermined distance above point 33 which is the lowest point of the conical socket 23.

The toy 11 preferably includes weight means 35 for enabling the toy 11 to be forced to wobble about indefinitely while the intermittent force is sustained. The weight means 35 is attached to the flange portion 29 adjacent the uppermost edge thereof as clearly shown in FIG. 2 of the drawing, and preferably extends completely around the flange portion 29. In other words, the weight means 35 facilitates sustaining the wobble spinning action for a prolonged period of time, i.e., presumably due to the inertia contributed therewith. However, it should be pointed out that a certain amount of skill is required to master the above-mentioned actuation sequence. Therefore, persons of all ages can derive excitement from the toy 11.

Figure 2:
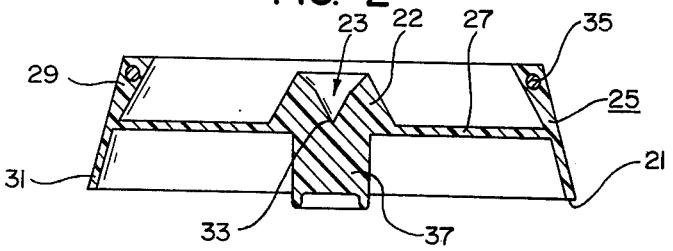
FIG. 2 is a sectional view taken as on the line II—II of FIG. 1.
Figure 3:
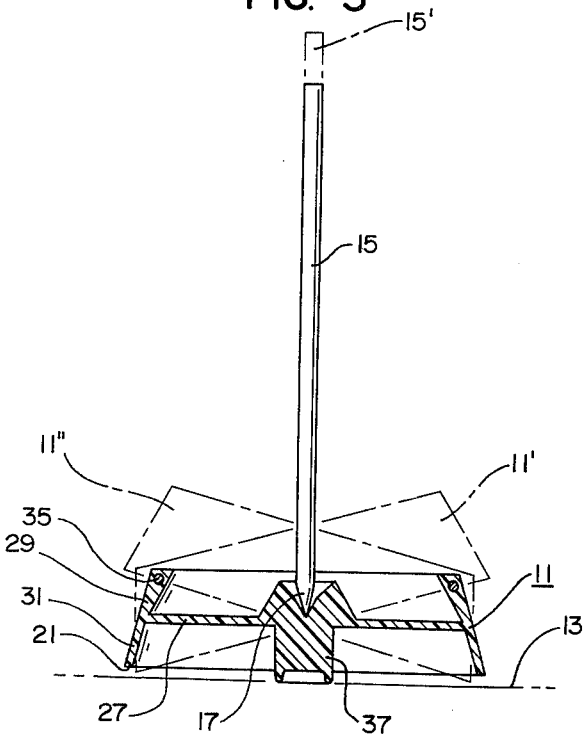
FIG. 3 is a view similar to FIG. 2 showing a pointed rod suitably engaging the toy and the rod and toy being phantomized to depict the wobbling action of the toy and the displacement of the rod.

The toy 11 preferably includes hub means 37 remotely disposed from the protuberance 22 as shown in FIG. 2 of the drawings. The hub means 37 is fixedly attached to the body 19 for the purpose of converting a substantially stable spinning movement of the toy 11 to the wobble unstalbe spinning movement thereof. From FIG. 3 of the drawings, it may be seen that the hub means 37 extends below the rim 21 and initially supports the toy 11, i.e., while it is spinning in a substantially stable manner. The slight tilting movement of the toy 11, which is inevitable, engages the rim 21 with the planar surface 13 which causes the toy 11 to quickly assume the wobble spinning movement with the rim 21 runningly engaging the planar surface 13 as the hub means 37 becomes totally disengaged therefrom. The toy 11 is phantomized in FIG. 3 of the drawing in a wobble spinning movement and is depicted in only two of the infinite positions assumed which are character referenced therein by the numerals 11' and 11''. In other words, from FIG. 3 of the drawing, it may clearly be seen that the toy 11 is neither horizontal nor vertical when assuming the wobble spinning movement 11', 11''. Additionally, the displacement of the rod is depicted in phantom and is character referenced therein by the numeral 15', i.e., the rod is urged up and down at a frequency which corresponds to the wobble movement of the toy 11 and with a downwardly directed force which by trial and error proves to be sufficient.

The toy 11 preferably is integrally formed from a resilient plastic substance for improving the response thereof for the wobble spinning movement. Additionally, the plastic substance defining the socket 33 provides lubrication or minimizes the friction between the rod 15 and the protuberance 22. In this regard, it may be desirable that the elongated rod 15 consists of a pencil having the carbon lead thereof sharply pointed which also minimizes the friction between the rod 15 and the protuberance.

Figure 4:
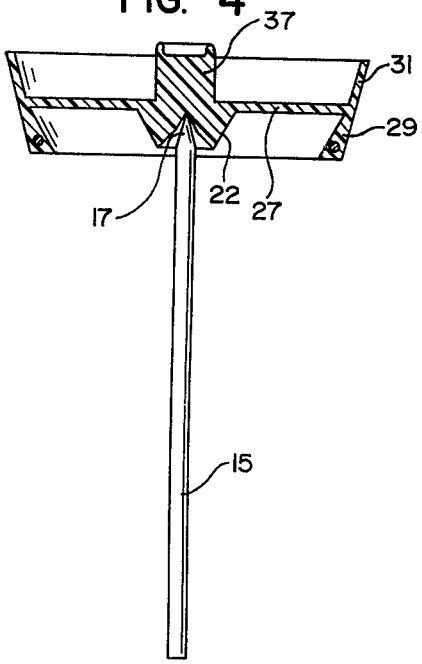
FIG. 4 is substantially an inverted view of FIG. 3 and shows another use for the toy and rod.

From FIG. 4 of the drawing, it may be seen that an alternate use of the toy 11 and the rod 15 is herein disclosed. More specifically, the toy 11 is inverted and while holding the rod 15 in one hand, the toy 11 is placed thereon, i.e., the rod 15 being received in the socket 23. Thence, the toy 11 may be gripped by the hub means 37 and twirled so as to rotate about the longitudinal axis of the rod 15 and in a stable spinning movement, somewhat like a gyroscope.

Although the invention has been described and illustrated with respect to a preferred embodiment thereof, it is to be understood that it is not to be so limited since changes and modifications may be made therein which are within the full intended scope of the invention.

I claim:

1. A spinning toy for spinning on a planar surface and for actuation by an elongated rod having a sharp pointed end, said toy comprising a disklike body having a circular rim for engaging the planar surface, said rim being disposed on the bottom of said body and defining the perimeter thereof, and an upwardly directed concentrically disposed protuberance having an upwardly opening conical shaped socket provided therein for guidingly receiving the sharp pointed end of said rod to cause an acceleration of a wobble spinning movement of said toy by an intermittent downwardly directed force being applied along the longitudinal axis of said rod.

2. A spinning toy for spinning on a planar surface and for actuation by an elongated rod having a sharp pointed end, said toy comprising a disklike body having a circular rim for engaging the planar surface, said rim being disposed on the bottom of said body and defining the perimeter thereof, an upwardly directed concentrically disposed protuberance having a conical shaped socket provided therein for guidingly receiving the sharp pointed end of said rod to cause an acceleration of a wobble spinning movement of said toy by an intermittent downwardly directed force being applied along the longitudinal axis of said rod, an upwardly directly circular flange portion fixedly attached to said body with said flange portion being superjacent said rim and extending upwardly a predetermined distance above the lowest point of said conical socket, and weight means for enabling said toy to be forced to wobble about indefinitely while said intermittent force is sustained, said weight means being attached to said flange portion adjacent the uppermost edge thereof.

3. A spinning toy for spinning on a planar surface and for actuation by an elongated rod having a sharp pointed end, said toy comprising a disklike body having a circular rim for engaging the planar surface, said rim being disposed on the bottom of said body and defining the perimeter thereof, an upwardly directed concentrically disposed protuberance having a conical shaped socket provided therein for guidingly receiving the sharp pointed end of said rod to cause an acceleration of a wobble spinning movement of said toy by an intermittent downwardly directed force being applied along the longitudinal axis of said rod, and hub means remotely disposed from said protuberance and being fixedly attached to said body for converting a substantially stable spinning movement of said toy to the wobble unstable spinning movement thereof, said hub means extending below said rim and initially supporting said substantially stable spinning toy until the slightest tilting movement of said toy causes said rim to be engaged with the planar surface which causes the toy to quickly assume the wobble spinning movement with said rim runningly engaging the planar surface as said hub means becomes totally disengaged therefrom.

4. A spinning toy for spinning on a planar surface and for actuation by an elongated rod having a sharp pointed end, said toy comprising a disklike body having a circular rim for engaging the planar surface, said rim being disposed on the bottom of said body and defining the perimeter thereof, an upwardly directed concentrically disposed protuberance having a conical shaped socket provided therein for guidingly receiving the sharp pointed end of said rod to cause an acceleration of wobble spinning movement of said toy by an intermittent downwardly directed force being applied along the longitudinal axis of said rod, an upwardly directed circular flange portion fixedly attached to said body with said flange portion being superjacent said rim and extending upwardly a predetermined distance above the lowest point of said conical socket, and weight means for enabling said toy to be forced to wobble about indefinintely while said intermittent force is sustained, said weight means being attached to said flange portion adjacent the uppermost edge thereof and said body being formed from a resilient plastic substance for improving the response thereof.

5. A spinning toy for spinning on a planar surface and for actuation by an elongated rod having a sharp pointed end, said toy comprising a disklike body having a circular rim for runningly engaging the planar surface, said rim being disposed on the bottom of said body and defining the perimeter thereof, an upwardly directed concentrically disposed protuberance having an upwardly opening conical shaped socket provided therein for guidingly receiving the sharp pointed end of said rod to cause an acceleration of a wobble spinning movement of said toy by an intermittent downwardly directed force being applied along the longitudinal axis of said rod, and weight means attached to said disklike body for enabling said toy to be forced to wobble about indefinitely while said intermittent force is sustained.

6. A spinning toy for spinning on a planar surface and for actuation by an elongated rod having a sharp pointed end, said toy comprising a flangelike ring member defining the perimeter of said toy; a disk member enclosing said ring member and being fixedly attached thereto with said disk member being disposed substantially midway the width of said flangelike ring member thus establishing, with respect to said disk member, upwardly and downwardly directed flange portions of said flangelike ring member; the lowermost peripheral portion of said downwardly directed flange portion including a circular rim for runningly engaging the planar surface, and an upwardly directed concentrically disposed protuberance fixedly attached to said disk member and having an upwardly opening conical shaped socket provided therein for guidingly receiving the sharp pointed end of said rod to cause an acceleration of a wobble spinning movement of said toy by an intermittent downwardly directed force being applied along the longitudinal axis of said rod.

7. The toy of claim 6 in which is included weight means for enabling said toy to be forced to wobble about indefinitely while said intermittent force is sustained, said weight means being attached to said flangelike ring member.

* * * * *